United States Patent [19]

Daane et al.

[11] Patent Number: 4,785,986

[45] Date of Patent: Nov. 22, 1988

[54] PAPER WEB HANDLING APPARATUS HAVING IMPROVED AIR BAR WITH DIMENSIONAL OPTIMIZATION

[75] Inventors: Robert A. Daane; Roy E. Downham, both of Green Bay, Wis.

[73] Assignee: Advance Systems, Inc., Oneida, Wis.

[21] Appl. No.: 61,328

[22] Filed: Jun. 11, 1987

[51] Int. Cl.[4] ..... B65H 20/14; F26B 13/20

[52] U.S. Cl. ..... 226/97; 34/160

[58] Field of Search ..... 226/97; 34/156, 160

[56] References Cited

U.S. PATENT DOCUMENTS

| | | | |
|---|---|---|---|
| 3,448,907 | 10/1969 | Otepka et al. | 226/97 |
| 3,964,656 | 6/1976 | Hella | 226/97 |
| 4,265,384 | 5/1981 | Daane | 226/97 |

*Primary Examiner*—Stuart S. Levy
*Assistant Examiner*—Lynn M. Sohacki
*Attorney, Agent, or Firm*—James E. Nilles

[57] ABSTRACT

Apparatus for drying a running paper web and floatingly suspending it without contact during the drying process, including air bars which are considerably larger than conventional air bars, for example, being about five and one-fourth inches square in cross-section, and being about three and one-half inches between their nozzle slots. These large air bars are spaced apart from one another along each side of the web a distance of about 15 inches. By so dimensioning the air bars providing the greater spacing between the air bars, considerably more drying capacity is provided, on the order of 14 per cent, and requiring less energy input into the dryer. Web drying equipment for sealingly mounting the air bars on the air supply duct means so that the bars can be individually adjusted toward and away from the web can also be tilted or pivoted to change the angle of the drying air being discharged against the web. An air distributing member defining an air distributing chamber within said bar having a pair of opposed and inclined side walls, and having a plurality of small holes therethrough to provide fine scale air turbulence for air passing through said holes to said slot nozzles. The distributing member also has a perforated inner plate spaced inwardly from said outer wall and through which pressurized air passes from the interior of said bar, including guide means for slidably supporting said perforated plate on the air distributing member.

6 Claims, 4 Drawing Sheets

PAPER WEB HANDLING APPARATUS HAVING IMPROVED AIR BAR WITH DIMENSIONAL OPTIMIZATION

BACKGROUND OF THE INVENTION

1. Field of the Invention

This invention relates to apparatus for drying and suspending a running paper web and comprising a dryer housing through which the web (which has been coated or printed on one or both sides) moves rapidly as it is floatingly suspended and guided on air cushions and without contact until the ink or other coating is dried. The invention relates to air bars for floatingly guiding and suspending an advancing paper web of indeterminate length.

2. Background Information

This invention pertains to paper web handling equipment having air bars for floatingly suspending a web and drying the material such as ink or coating on the web, while not permitting the web to touch any supporting surfaces as the web moves rapidly through the elongated dryer.

This invention is in the nature of an improvement over the paper web handling air bars shown in the following U.S. Pat. Nos.: Vits—U.S. Pat. No. 3,181,250, issued May 4, 1963; Otepka—U.S. Pat. No. 3,448,907, issued June 10, 1969; Frost—U.S. Pat. No. 3,549,070, issued Dec. 22, 1970; Creapo—U.S. Pat. No. 3,739,491, issued June 19, 1973; Gardner—U.S. Pat. No. 3,452,447 of July 1, 1969; and Stibbe—U.S. Pat. No. 3,873,013, issued Mar. 25, 1975.

The air bars shown in the above patents were of relatively small size, and were spaced relatively close together along the length of the web being handled. While those devices did perform satisfactorily, they required a considerable amount of energy, both electrical and gas, in order to effectively dry the running web.

SUMMARY OF THE INVENTION

The present invention provides apparatus for drying a running paper web and floatingly suspending it without contact during the drying process, and which apparatus includes air bars spaced along both the upper and lower surface of the web. The air bars provided by the present invention are considerably larger than conventional air bars, for example, being about five and one-quarter inches square in cross-section, and being about three and one-half inches between their nozzle slots. In other words, these slots or nozzles are spaced apart from one another on the air bar a distance of about 3.5 inches. Furthermore, these large air bars are spaced apart from one another along each side of the web a distance of about 12 to 15 inches which is a greater distance than conventionally used.

By so optimizing the dimensioning the air bars themselves and using the 12 to 15 inch spacing between the air bars, considerably more drying capacity or line speed capability is provided, on the order of 14 per cent, and at the same time requiring no more energy input into the dryer in the form of electricity or gas. Alternatively, the same drying capacity can be achieved using about 14 per cent less energy and with only 10 per cent more dryer length. More specifically, the invention provides drying apparatus of the above type in which the air bars are preferably spaced 3/16 to ¼ of an inch from the theoretical web line and then due to the staggered relationship between the upper and lower air bars and the air pressure cushions developed on the web by the air bars, a sine wave is formed in the web and the clearance between any air bar and the moving web is in the order of ⅜ of an inch.

With the present 12 to 15 inch spacing between the air bars on each side of the web and if, in some situations, it is desirable to have a longer dryer, with the present invention a fewer number of air bars can be used and requiring less heat input, and producing a greater line speed capability. Furthermore, a 10 to 15 per cent slower blower speed is possible which results in less wear and maintenance on the air supply fan bearings and results in lower horsepower requirements per unit of drying capacity, i.e., heat transfer.

These and other objects and advantages will appear hereinafter as this disclosure progresses, reference being had to the accompanying drawings.

DESCRIPTION OF A PREFERRED EMBODIMENT

Figure 1:
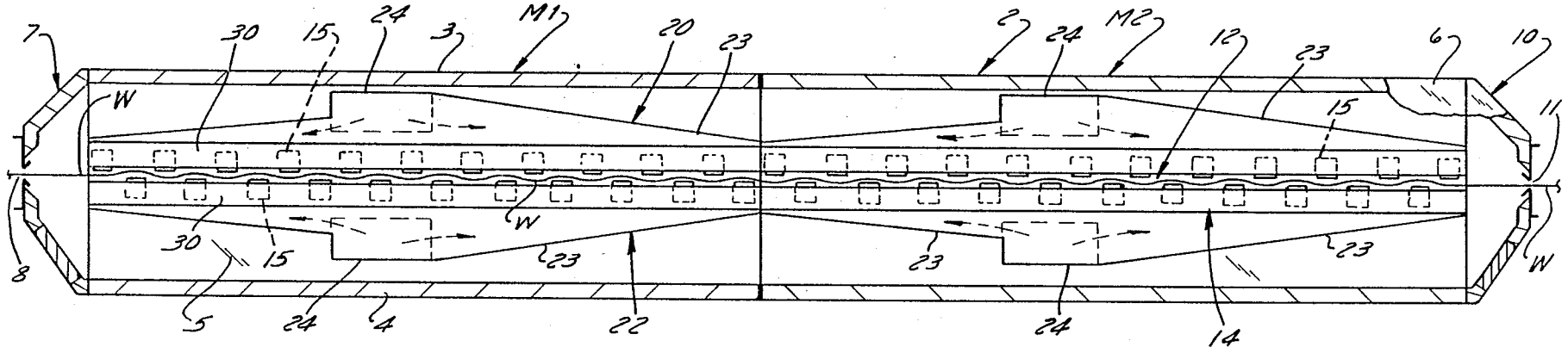
FIG. 1 is a vertical cross-sectional view taken along the length of a web drying apparatus embodying the present invention, the view being generally schematic in nature.

Web drying apparatus for floatingly suspending a running web is shown in FIG. 1 and includes an elongated dryer housing 2 which is enclosed by its insulated top 3, insulated bottom 4, one insulated side 5 and an opposite insulated side 6. An insulated inlet end 7 has a horizontal slot 8 through which the web W enters. The opposite, exit end is formed by the insulated end wall 10 and a corresponding slot 11 therein through which the web exits. In the FIG. 1 showing, two similar housing modules Ml and M2 are joined together end to end. A single module may be used in some installations. The length of a module may vary, for example, from eleven to twenty feet, but a length of twelve to fourteen feet would be average.

The arrangement includes an upper air bar assembly 12 and a lower air bar assembly 14 between which the web W passes. Assemblies 12 and 14 each have a series of air bars 15 located in spaced apart relationship along each of the upper and lower sides of the web and these bars are transversely positioned across the web. It will be noted that the upper air bars are in staggered, spaced relationship along the web with respect to the lower air bars to thereby cause the web to assume a conventional sine wave form when in operation, as shown.

Figure 2:
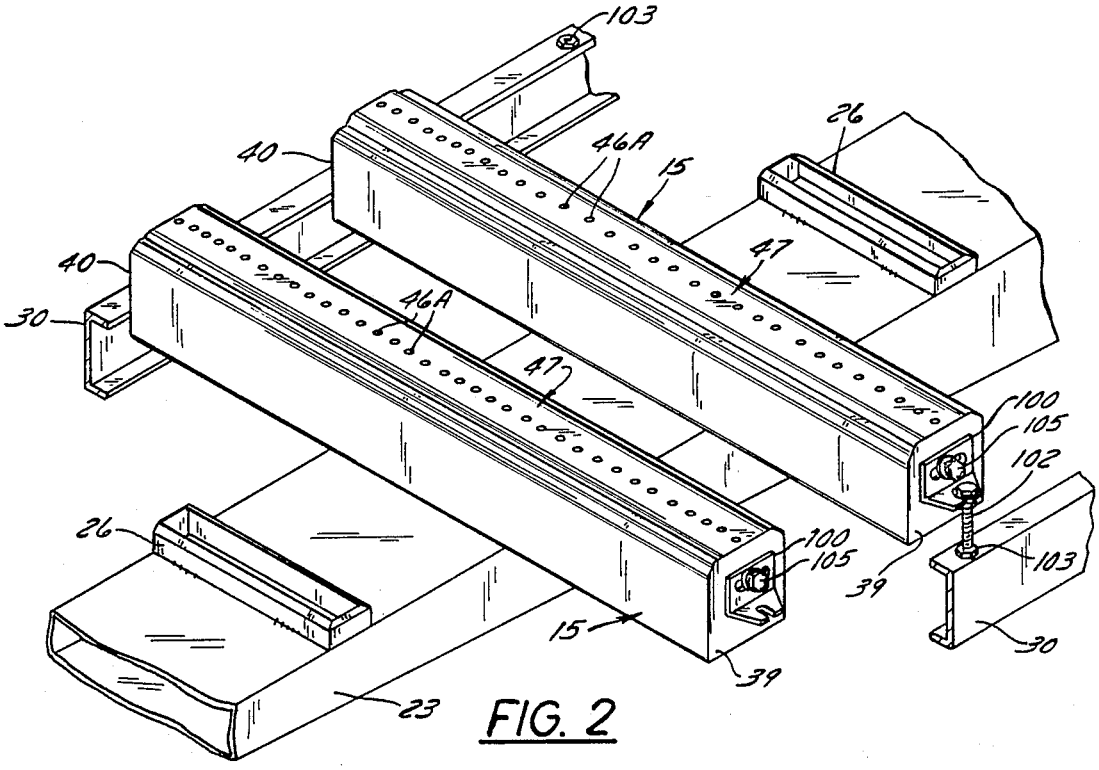
FIG. 2 is a fragmentary, enlarged view of a portion of the apparatus shown in FIG. 1, certain parts being removed for the sake of clarity in the drawings, and showing a pair of air bars as they are mounted on the lower duct means.

An air supply duct means 20 is provided for each module of the upper air bars 15 while a similar air supply duct means 22 is provided for the lower set of air bars 15. These duct means include the longitudinally extending ducts 23 that extend from the central supply duct 24. The ducts 23 each have a series of air feed necks 26 (FIGS. 2 and 3) extending transversely thereacross and at spaced locations along their length. An air bar 15 is in air receiving communication with each of the necks 26 and thus the air supply ducts furnish pressurized air to each of the air bars for ultimate discharge against the web to floatingly support the latter.

The air supply duct means includes the header frame 30 which is mounted within the housing and acts to support the air supply system.

Figure 3:
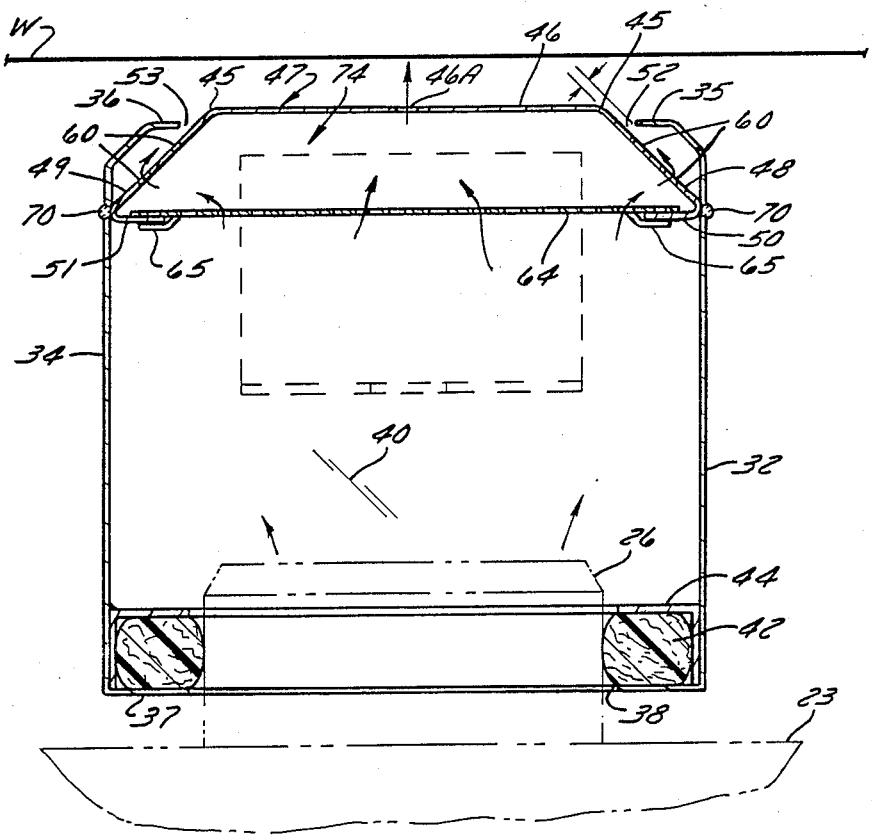
FIG. 3 is a transverse cross-sectional view through one of the air bars shown in FIGS. 1 and 2, but on an enlarged scale.

The air bar shown in detail in FIG. 3 includes the side walls 32, 34 which terminate at their upper ends in the inwardly turned flanges 35, 36, respectively.

The air bars also have end walls 39 and 40 which are welded at the ends of the bars.

Figure 4:
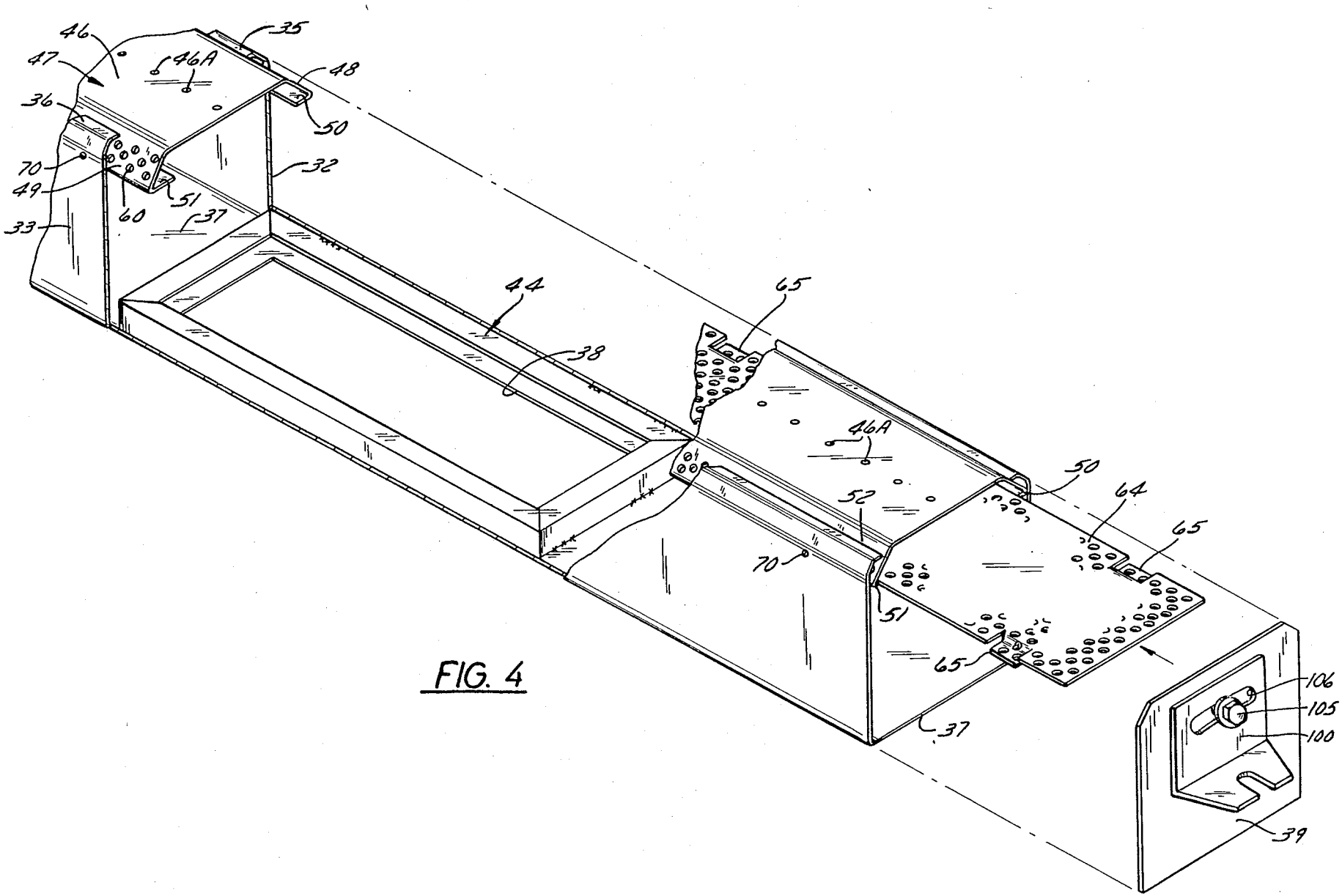
FIG. 4 is a perspective, exploded, fragmentary view of a portion of the air bar shown in the other figures.

The air bars also have a lower wall 37 formed between the side walls and in which a rectangular opening 38 is formed for the purpose of receiving the air feed neck 26 of the duct means. It will be noted that an O-ring type seal 42 is provided in the U-shaped (in cross section) gasket retainer 44 of rectangular form (FIG. 4). The retainer has the open side of its C-shape facing inwardly and is located around the opening 38 in inner wall 37 of the air bar. The seal 42 is located in the C-shape form of the retainer and acts to sealingly embrace the neck 26 of the duct means when the air bar is assembled on the duct means. With this telescoping joint between the air bar and the duct means, the air bars can be adjusted toward and away from the web to thereby precisely locate the bar in respect to the web. This joint also permits the duct to expand or contract, due to the temperature differentials encountered, without disturbing the setting of the air bars relative to the web. The joint also insures easy and accurate assembly of the bars on their duct. As will later appear, this joint also permits angular adjustment of the bars, and particularly of the discharging air, with respect to the web.

The air bar also includes an upper wall 46 (referred to as the air bar face) which is located adjacent the web. This wall 46 may have a center row of air discharge holes 46A for furnishing additional air to the web, if needed. Without center hole impingement, the region of an air bar between the slots 52 and 53 is rather quiet and heat transfer is very small in that region. Adding air impingement in this region adds directly to heat transfer without interfering with or detracting from the heat transfer effectiveness of the air turbulence already there. For example, if additional air impingement were added to the regions outside the slot jets, the additional heat transfer would be very small because there already is rather good heat transfer there associated with the flow of impingement air away from the slots. In the case of the present air bars, the additional heat transfer derived from the center hole impingement is about 10 per cent while the additional supply air needed to feed these round jets is slightly less than 10 per cent. For some sensitive products, the.round jet impingement may lead to streaks in the dried product. In such cases the center holes are omitted.

The wall or bar face 46 is part of the air distributing member 47 which also includes the inclined walls 48 and 49 and the inner, inwardly turned flanges or lips 50 and 51. The angle at the juncture 45 of walls 46 and inclined walls 48 and 49 is made having as sharp a break in the sheet metal as possible, so as to preclude a Coanda effect of the discharging air. In other words, this prevents the Coanda effect of the air streams trying to follow the sheet metal surfaces around the breaks. This results in stability of the air flow pattern and a more consistent impingement of sharper slot jets onto the web with maintenance of higher heat transfer regardless of web clearance (within limits). The inclined walls 48 and 49 each having holes 60 therein are inclined at about an angle of 45° to the web, that is, to the inner wall 46, as will presently be more fully explained.

The inclined walls 48 and 49 together with the inwardly turned flanges 35 and 36, respectively, form the nozzle slots 52 and 53, respectively. These slots are preferably of a width of 0.085 to 0.090 after gapping.

It will be noted that flanges 35 and 36 lie slightly below the wall 46 in respect to the web, on the order of 0.125 plus or minus 0.015 inches.

A perforated plate 64 has a series of depressed tabs 65 (FIGS. 3 and 4) pressed therefrom and spaced along the length of plate 64 so that the perforated plate is slidably engageable along the inwardly turned flanges 50 and 51. The member 47 is rigidly secured within the air bar by means of welding plugs 70 along each of its sides and by means of which it is securely fastened to the side walls 32 and 34 of the air bar. Thus, the tabs 65 and flanges 50 and 51 form guide means for slidably supporting the perforated plate 64. The bifurcations formed by the tabs 65 on the perforated plate provide an easily manufactured and readily assembled perforated distribution plate.

In operation, pressurized air is introduced from the duct supply means into the interior of the air bar via the neck 26 of the ducts and then the air flows through the perforated plate 64 which causes it to be evenly distributed within the equalizing chamber 74 of the air bar and without appreciable cross currents. Then the pressurized air passes through the small apertures 60 of the inclined portions and through the discharge slot nozzles 52 and 53 against the web, at an angle of about 45°.

Referring again to the 45° jet angle of the air bars, having a smaller angle than 45° between the jets and the web leads to a slightly higher web supporting cushion pressure with the same jet velocity and thickness, but it results in lower heat transfer. Furthermore, a smaller angle either requires that lips 35 and 36 (in FIG. 3) be closer to the web or otherwise leads to an excessively long distance between each slot and the air bar face. In either case, regions of partial vacuum are created between those lips and the web. This causes web flutter and less stable web flotation. Furthermore, as this angle is decreased, heat transfer deteriorates rapidly. If a larger angle than 45° is used (i.e., the jets are aimed more nearly perpendicular to the web), web supporting cushion pressure is decreased and heat transfer is not improved significantly.

The air bars provided by the present invention are larger than conventionally used and a distance of about three and onehalf inches is provided between the slots 52 and 53. These large air bars are preferably and generally square in crosssectional shape, the overall width (from wall 32 to 34) being about 5.25 inches and the depth (from wall 46 to wall 37) also being about 5.25 inches. By making the air bars of this size and shape, it has been found that the air bars can be spaced apart from one another a greater distance than conventionally practiced while achieving improved heat transfer capabilities. It has been found that by spacing the air bars about 12 to 15 inches from one another, (center to center), considerably more drying capacity is provided, generally on the order of 14 per cent more capacity, while at the same time requiring less energy, that is heat, into the dryer to do a given drying job.

More specifically, in order to do any given web drying job (with a certain web speed, web weight, liquid to be evaporated, etc.), a suitable combination of three basic dryer parameters must be selected. These are: dryer length, dryer air temperature and air to web heat transfer coefficient (the mass transfer coefficient automatically remains proportional to the heat transfer coefficient). Within some practical constraints, any two of these parameters can be selected arbitrarily and then a suitable value of the third parameter can be found to make the dryer do the given job. For example, if it is standard practice to use the air bar as described herein at a supply air temperature of 400° F., an air bar outlet velocity of 12,500 fpm and an air bar spacing of 12 inches center to center, this will provide for each side of the web passing through the flotation dryer; a heat transfer coefficient "h" of about 33 btu/hr-square feet - degree F. It is then only necessary to select a dryer length that will do a given job. When there is motivation for a longer dryer than that given by this practice, such as arbitrary customer preference or a real benefit, such as avoidance of heavy weight web blistering when drying certain coatings, it is advantageous to reduce the heat transfer coefficient. This can be done by reducing the air bar flow intensity (cfm per square foot of dryer area) which in turn can be done either by reducing air bar slot nozzle velocity or by spreading the air bars farther apart using the same velocity. Assume, for example, that it is desired to increase the dryer length by 25 per cent and keep the same total air bar flow rate. We can do this either by reducing the air bar slot nozzle velocity to 10,000 fpm, keeping the same 12 inch air bar pitch, or by spreading the air bars out to a pitch of 15 inches, keeping the same 12,500 fmp velocity. Based on experimental data on local h profiles and on average values of h at different velocities, the average h will drop to about 86 per cent of the original if velocity is reduced to 10,000 fpm while it will drop to about 91 per cent if air bar spacing is increased to 15 inches. In order to appreciate the significance of these values, if all web and dryer parameters are kept constant except web speed, dryer length, L, and heat transfer coefficient, h, then speed is proportional to the product of h times L. With reduced air bar slot nozzle velocity, hL is 107.5 per cent of the value for the original shorter dryer while with increased air bar spacing hL is 113.8 per cent of the shorter dryer value. With the same web weight, coating coverage, air temperature, final dryness, exit web temperature, etc., the allowable web speed will be 7.5 per cent faster with the reduced nozzle velocity, in the longer dryer while it will be 13.8 per cent faster with the increased air bar spacing in the same dryer.

The wall or face 46 of the opposed upper and lower air bars are spaced apart a distance of about three-eighths of an inch. In other words, the walls 46 of the upper air bars are spaced from the corresponding surfaces of the lower air bars three-eighths of an inch under normal circumstances. When the dryer is in operation, the web assumes a sine wave form as shown in FIG. 1 and under those circumstances the web is actually a distance of about three-eighths of an inch from the air bar walls 46.

Figure 8:
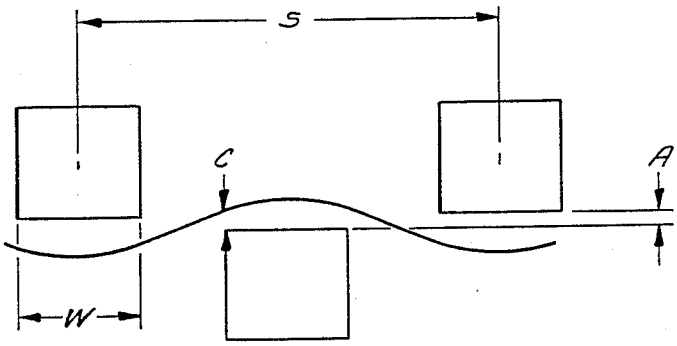
FIG. 8 is a diagram showing dimensional symbols and showing a sine wave pattern of the web in respect to air bars.

Within limits, the web supporting cushion pressure between the web W and the air bar face 46 does not depend on the air bar slot to slot width. Therefore, the web supporting force (pressure times area) will be proportional to the slot to slot dimension. In other words, an air bar with a large slot to slot width provides more web supporting force than does a narrower air bar and this extra force is free (i.e., no more supply air and no more velocity of the air are required). The cushion pressure is, however, a decreasing function of the clearance between the web and the points on the air bar face nearest to the slots. This may be expressed symbolically as:

$$PC = f(C) \times PS$$

where PC is cushion pressure and f(C) is the experimentally determined decreasing function of clearance, C, and PS is the air bar supply pressure. As shown in FIG. 8, showing dimensional symbols with:

S = air bar spacing on one side of the web
w = slot to slot air bar width
A = air bar to air bar clearance
C = web to air bar face clearance.

Force balance requires that with a web tension, t:

$$C = PS \times w \times f(C) \times (S - 2 \times w)/8 \times t + A/2$$

It is evident that there is an optimum value of w for which clearance, C, is a maximum for other variables held fixed.

However, there are two other important attributes of the web sine wave leading to stable web flotation and web curl and wrinkle suppression. They are web curvature over or under the air bar faces and the angle of wrap of the web over or under each air bar. In order to maximize these values as well as web clearance, the dimensions A, w and S must be properly selected. We have found that optimum dimensions are achieved if:

$$S = 3.5 \times w$$

and if:

$$A = 0.03 \times t/PS$$

where t is web tension in pound/inch web width and the other quantities are expressed in inch and pound units.

For optimum heat transfer, for any given air blowing horsepower, we have found that the slot openings should have a thickness of about:

$$\text{Slot Width} = 0.0075 \times S$$

This also leads to adequate web flotation cushion pressure for most thin, flexible webs.

Large web clearance can be achieved by a large scale factor (i.e., making all dimensions of the air bar large, but in proportion to each other). However, a large scale leads to smaller heat transfer. For light weight, flexible, thin webs such as paper, plastic films and the like, the large scale turbulence accompanying large scale size results in greater web flutter. For such webs, which are the most commonly encountered webs in flotation drying, we have found that a slot thickness of 0.085 and 0.090 inches and other dimensions in the ratios stated leads to an optimum air bar dryer configuration from the standpoints of good, quiet, stable web flotation and high heat transfer. Specifically, we prefer to select S to be about 12 inches and w to be about 3.5 inches.

If dryer length is not restricted (for example, by building space), we have found that improved economy of operation is achieved by increasing the spacing, S, to a greater value than given in the above relationships. This leads to some loss of stability of web flotation and some loss in heat transfer coefficient. However, more drying can be done using the same number of air bars spaced farther apart. Specifically, if we increase S to 15 inches and leave the other dimensions the same as for the dryer with the 12 inch air bar spacing we can achieve about 14 per cent more drying with the same number of air bars and the same air blower capacity as with the 12 inch spacing configuration.

With the present invention, it has been found that a fewer number of air bars can be used for a given installation and they require less heat input and result in a higher heat transfer coefficient. Furthermore, as a result a slower blower speed can be used for furnishing air to the dryer which results in less wear and maintenance of the blower and associated parts and results in lower horsepower requirements thereof being about eight per cent more efficient than any flotation device now marketed as far as we are aware.

Figure 5:
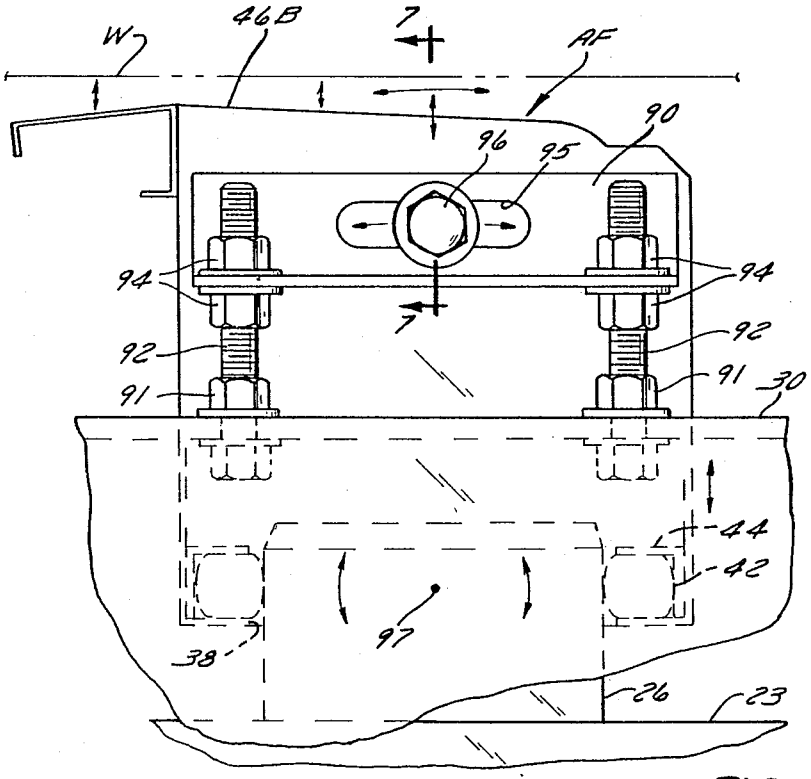
FIG. 5 is an end elevational view of an adjusting means for an air bar.

FIG. 5 illustrates an improved adjusting means for an air foil type air bar AF, such as that shown in FIG. 13 of U.S. Pat. No. 4,194,973, issued Apr. 15, 1980 to Robert A. Daane. The adjusting means for such an air bar is possible with the use of the O-ring sealing means and air duct neck construction previously referred to. An adjusting means of this character is located at each end of the air bar. An angle iron bracket 90 is held, by bolt 96, across each end of the air bar. A pair of adjustable jacking bolt means 92 are secured to the header frame 30 by nuts 91 and extend upwardly through the outwardly extending flange of bracket 90 and are held in place by the pair of nuts 94. In order to adjust the bar AF toward and away from the web, the bolt 96 is tightened and nuts 94 are adjusted on bolts 92.

Figure 7:
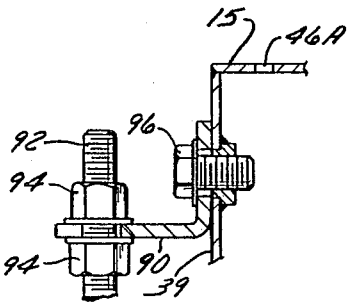
FIG. 7 is a sectional view taken along line 7—7 in FIG. 5.

A slot 95 is provided through the bracket 90 and bolt means 96, secured to the end of the air bar (FIG. 7), extends through the slot 95. The angle of the air bar relative to the web W can be adjusted by loosening bolts 96, thereby tilting the air bar about the effective pivot point 97. When the desired angle of the bar has been attained, the bolts 96 are tightened. It will be noted that the O-ring type seal 42 bearing against the neck 26 can accommodate any angular movement of the bar. Thus, the angle of the bar outer wall 46B can be accurately adjusted relative to the web. The air bar of the air foil type can thus be adjusted within a range of a few degrees to result in a quieter web that contributes to web stability.

Thus, with the arrangement of FIG. 5, the air bar can be adjusted toward and away from the web by means of the O-ring type seal and neck 26 arrangement and it can also be adjusted angularly with respect to the web by means of the clamping bolt 96.

Figure 6:
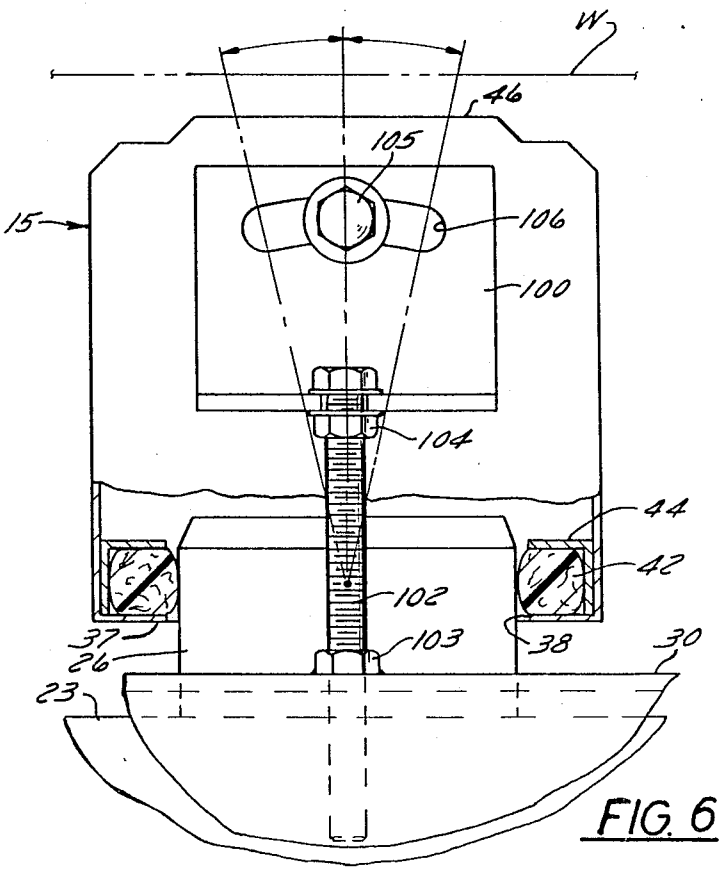
FIG. 6 is an end elevational view of another adjusting means for an air bar.

FIG. 6 shows a similar angular adjustment for the air bar 5 previously described. In this instance the bar is held on brackets 100 (one on each end of the bar) by bolts 105. A jacking bolt 102 is fixed to the header frame 30 by means of the nut 103 which is welded to the header frame 30. A nut 104 secures the bar to the bolt 102. The jacking bolt 102 can thus be adjusted in nut 103 for adjusting the distance of the air bar 15 toward and away from the web W.

In order to angularly adjust the bar 15 relative to the web, the clamping bolt 105, extends through a slot 106 in bracket 100 and is held on the end of the air bar. The bolt 105 can be loosened to swing the air bar to the adjusted angular position and then bolt 105 is tightened to clamp the air bar in such adjusted angular position. This swinging or pivotal movement of the air bar is permitted by the gasket 42 and duct neck 26 previously described.

What is claimed as the invention is:

1. Web drying apparatus for floatingly suspending a running web while being dried, including an elongated dryer housing through which the web passes, and air bars in said housing and located in spaced apart relationship along each of the upper and lower sides of the web and transversely across said web, the upper bars being in staggered spaced relationship along said web with respect to the lower air bars to thereby result in a sine wave form of the running web, said bars being spaced apart a distance of about twelve to fifteen inches from one another along the upper side of the web and also spaced apart a distance of about twelve to fifteen inches along the lower side of the web, said air bars each having a pair of slot nozzles extending transversely of the web and through which pressurized air is directed against the web for drying and floating thereof, the slot nozzles of an air bar being spaced apart from one another a distance of about three and one-half inches when measured in a direction along the length of the web.

2. Ths apparatus set forth in claim 1 wherein the slot nozzles direct the air against the web at an angle of about 45°.

3. Web drying apparatus for floatingly suspending a running web while being dried, including an elongated dryer housing through which the web passes, and air bars in said housing and located in spaced apart relationship along each of the upper and lower sides of the web and transversely across said web, the upper bars being in staggered spaced relationship along said web with respect to the lower air bars to thereby result in a sine wave form of the running web, said bars being spaced apart a distance of about twelve to fifteen inches from one another along the upper side of the web and also spaced apart a distance of about twelve to fifteen inches along the lower side of the web, said air bars each having a pair of slot nozzles extending transversely of the web and through which pressurized air is directed against the web for drying and floating thereof, the slot nozzles of an air bar being spaced apart from one another a distance of about three and one-half inches when measured in a direction along the length of the web, said bars including an air distributing member defining an air distributing chamber within said bar and having an outer wall located between said slot nozzles and spaced outwardly therefrom to provide an air pressure supporting surface for a web, said distributing member having a pair of opposed and inclined side walls, one adjacent each of said slot nozzles, said inclined walls having a plurality of holes therethrough and along their length to provide air turbulence for air passing through said holes to said slot nozzles; said distributing member also having a perforated inner plate spaced inwardly from said outer wall and located immediately adjacent the inclined walls and through which perforated inner plate pressurized air passes from the interior of said bar.

4. The bar as claimed in claim 3 wherein the juncture formed between said outer wall and said inclined side walls is formed as a sharp break to prevent a Coanda effect of air issuing from said slot nozzles.

5. The air bar as set forth in claim 1 including an air distributing member defining an air distributing chamber within said bar and having an outer wall located between said slot nozzles and spaced outwardly therefrom to provide an air pressure supporting surface for a web, said distributing member having a pair of opposed and inclined side walls, one adjacent each of said slot nozzles, said inclined walls having a plurality of small holes therethrough and along their length to provide fine scale air turbulence for air passing through said holes to said slot nozzles; said distributing member also having a perforated inner plate spaced inwardly from said outer wall and located immediately adjacent said inclined walls through which perforated inner plate pressurized air passes from the interior of said bar; said outer wall, said perforated inner plate and said inclined side walls defining said air distributing chamber from which pressurized air passes through said small holes of said inclined walls.

6. The air bar according to claim 5 including guide means for slidably supporting said perforated plate on the air distributing member for assembly of said plate in said bar.

* * * * *